US006277056B1

(12) United States Patent
McBride et al.

(10) Patent No.: US 6,277,056 B1
(45) **Date of Patent: *Aug. 21, 2001**

(54) MULTIPLE LEG MOVEMENT EXERCISE APPARATUS

(75) Inventors: Robert W McBride, Springfield, MO (US); Paul Chen, Taichung (TW)

(73) Assignee: Stamina Products, Inc., Springfield, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/326,556

(22) Filed: Jun. 7, 1999

Related U.S. Application Data

(63) Continuation of application No. 09/021,534, filed on Feb. 10, 1998, now Pat. No. 5,916,065.

(51) Int. Cl.[7] ..... A63B 69/16; A63B 22/04
(52) U.S. Cl. ..... 482/57; 482/51
(58) Field of Search ..... 482/51, 52, 57, 482/70, 79, 80

(56) References Cited

U.S. PATENT DOCUMENTS 5,916,065 * 6/1999 Mcbride et al. ..... 482/57

* cited by examiner

*Primary Examiner*—Stephen R. Crow
(74) *Attorney, Agent, or Firm*—Pillsbury Winthrop LLP

(57) ABSTRACT

An exercise apparatus includes a frame, a seat for a user, and a feet engageable moving mechanism carried by the frame and including a pair of feet engaging members. The feet engaging members present different foot receiving surfaces to be engaged by the feet of a user for providing different leg movements depending on the position of the user and the user's legs. First foot receiving surfaces support a user in a standing position and move the user's feet in a generally elliptical path of motion simulating a natural foot striding. Second foot receiving surfaces are spaced further away from the seat than the first foot receiving surfaces and have vertical components enabling a seated user to extend his legs forwardly and exert, with the bottom of his feet, forces having substantial horizontal components to the feet engaging members to drive the feet engageable moving mechanism against its internal resistance. The apparatus may also include third foot receiving surfaces spaced closer to the seat than the first foot receiving surfaces and having horizontal components enabling a seated user to extend his legs downwardly and exert, with the bottom of his feet, forces having substantial vertical components to the feet engaging members to drive the feet engageable moving mechanism against its internal resistance. Third foot receiving surfaces are constructed and arranged to direct the user's feet in generally circular paths of motion.

21 Claims, 9 Drawing Sheets

MULTIPLE LEG MOVEMENT EXERCISE APPARATUS

This is a continuation of application Ser. No. 09/021,534, filed Feb. 10, 1998, now U.S. Pat. No. 5, 916,065.

BACKGROUND AND SUMMARY OF THE INVENTION

The present invention relates to a pedal-type leg exercise apparatus on which a user may perform different types of peddling leg exercises.

Various seated pedal-type exercise apparatuses have been commercially available for some time. Such apparatuses include a frame supported on a floor and having an integrated seat and a pedal mechanism which can be cyclically driven by a seated user. A handle structure is positioned so as to accommodate a seated user. For example, a stationary bicycle exercise machine provides a frame with a saddle-type seat and a pedal mechanism with foot pedals disposed generally directly below the seat and permits an exerciser to sit on the seat in a generally upright posture and drive the pedal mechanism, thus simulating bicycling.

A more recently popular style of pedal-type leg exercise apparatus is constructed for standing striding exercise and is known as an elliptical strider. Commercially available elliptical striders include a frame supported on a floor which carries a pedal moving mechanism. A handle structure is positioned so as to only accommodate a standing user, and no integrated seat is provided. The user stands in a generally upright posture on a pair of foot-engaging members of a pedal moving mechanism which causes the user's feet to traverse generally elliptical paths of motion. The elliptical paths of motion simulate the natural stride of a person's foot while running or walking, and the prior art proposes a variety of mechanisms by which such elliptical foot motion can be accomplished. Elliptical striders are viewed as alternatives to stair step climbing exercise machines which involve less pounding on the user's joints than stair climber exercisers.

Accordingly, to be able to perform a seated cycling exercise and standing elliptical striding exercise, a user would conventionally need a different exercise apparatus for each exercise. The need for multiple exercise apparatuses can present space problems, especially for the home user, and also lends to the added expense of purchasing multiple exercisers. Consequently, many users settle on a single apparatus and are therefor only able to perform a single pedal-type leg exercise.

It is an object of the present invention therefore to provide a single exerciser which enables a user to perform both seated cycling exercises and standing elliptical striding exercises thereon. The exerciser comprises a frame constructed and arranged to be supported exercises thereon. The exerciser comprises a frame constructed and arranged to be supported on a generally horizontal supporting surface and a feet engageable moving mechanism including a pair of foot-engaging members carried by the frame in a position to support a user in a standing position thereon with a generally upright posture.

The feet engageable moving mechanism is constructed and arranged to enable each of the foot-engaging members to move in a generally elliptical cycle of movement simulating a cycle of striding foot movements by the user's feet supported thereon.

The exerciser further includes a seat mounted on the frame in a position to support a user seated thereon and a hand grip assembly mounted on the frame for movement between a first position accommodating the hands of a standing user and a second position accommodating the bands of a seated user.

The feet engageable moving mechanism provides seated foot-engaging positions and is constructed and arranged to support the feet of a user at the seated foot-engaging positions while the user is seated on the seat for movement through a cycle of foot movements different from the elliptical cycle of movements.

Accordingly, the exerciser of the present invention provides in a single device an exerciser that accommodates both seated cycling exercises and standing elliptical striding exercises while providing a hand grip assembly that can be grasped by both a seated and a standing user. The exerciser is not overly complex or costly as the same feet-engageable moving mechanism is used for both the seated cycling exercise and the standing elliptical striding exercise.

A specific type of seated cycling exercise provided by some conventional seated cycling apparatuses is a recumbent cycling exercise. The apparatus includes a frame supported on a floor and on which is mounted a seat, typically including a seat back structure, and a pedaling mechanism disposed generally below and out in front of the seat. The seated user extends his or her legs forwardly to engage and drive the pedaling mechanism with substantially horizontal forces applied by the legs during the forward leg extensions. The recumbent seated position and outstretched orientation of the user's legs cause the user's feet to always be in front of the user's knees, and result in different leg muscles being exercised compared to the upright stationary bicycle. In addition, the seat back structure of a recumbent apparatus can alleviate back discomfort experienced by some users when using upright stationary bicycles.

Again, however, if a user wishes to have the choice of performing either a recumbent cycling exercise or a standing elliptical striding exercise, the user would need two different apparatuses, one for each type of exercise.

Accordingly, it is a further object of the present invention to provide in a single apparatus, a device on which a user can perform either a recumbent cycling exercise or a standing elliptical striding exercise. The object is accomplished by a multi-purpose exercise apparatus which comprises a frame structure constructed and arranged to be supported on a generally horizontal surface, a seat mounted on the frame structure for supporting a user seated thereon; and a feet engageable moving mechanism carried by the frame structure and constructed and arranged to be engaged by the legs of a user. The feet engageable moving mechanism presents: (1) first foot receiving surfaces positioned on the feet engageable moving mechanism to support a user standing thereon with a generally upright posture, and constructed and arranged to enable each of the user's feet to move in generally elliptical cycles of movement simulating cycles of striding foot movements by the user's feet supported thereon; and (2) second foot receiving surfaces spaced further from the seat than the first foot receiving surfaces and having a vertical component enabling the user to engage the second foot receiving surfaces with a bottom portion of the user's feet while seated on the seat and to alternately extend each of the user's legs during leg extension strokes thereof to apply a substantially horizontal force component to the second foot receiving surfaces with the bottom portion of the user's feet to drive the feet engageable moving mechanism against its internal resistance. The second foot receiving surfaces are positioned on the feet engageable moving mechanism such that each of the user's legs has the foot thereof maintained forwardly of the knee thereof throughout a range of leg movement including the leg extension strokes and leg return strokes.

Accordingly, the multi-purpose exercise apparatus of the present invention provides in a single device an exerciser that accommodates both recumbent cycling exercises and standing elliptical striding exercises. The exerciser is not overly complex or costly as the same feet-engageable moving mechanism is used for both the recumbent cycling exercise and the standing elliptical striding exercise.

Seated pedal-type exerciser apparatuses and standing elliptical striding apparatuses are often equipped with oscillating handle members to be grasped by the user for movement in an oscillatory manner toward and away from the user to effect an exercise movement for each of the user's arms while performing the seated pedal-type exercise or the standing elliptical striding exercise. The seated pedal-type exerciser includes an integrated seat, and the oscillating handle members are positioned to be grasped by a seated user. The standing elliptical striding exerciser does not include an integrated seat, and the oscillating handle members are positioned to be grasped by a standing user. Thus, if a user wishes to have the flexibility of performing a seated pedal-type exercise while simultaneously performing an oscillating arm exercise or a standing elliptical striding exercise while simultaneously performing an oscillating arm exercise, the user would need two different exercise apparatuses.

It is, therefore, a further object of the present invention to provide in a single apparatus a device on which a user may perform either a seated pedal-type exercise while simultaneously performing an oscillating arm exercise or a standing elliptical striding exercise while simultaneously performing an oscillating arm exercise. This object is achieved by n exerciser comprising a frame constructed and arranged to be supported on a generally horizontal supporting surface and a feet engageable moving mechanism including a pair of foot-engaging members carried by the frame in a position to support a user in a standing position thereon with a generally upright posture. The feet engageable moving mechanism is constructed and arranged to enable each of the foot-engaging members to move in a generally elliptical cycle of movement simulating a cycle of striding foot movements by the user's feet supported thereon. The exerciser further comprises a seat mounted on the frame in a position to support a user seated thereon, and the feet engageable moving mechanism provides seated foot-engaging positions and is constructed and arranged to support the feet of a user at the seated foot-engaging positions while the user is seated on the seat for movement through a cycle of foot movements different from the elliptical cycle of movements. The exerciser includes hand grip members mounted on the frame for oscillatory movement toward and away from the user and are constructed and arranged to be grasped by either a seated user or a standing user for movement in an oscillatory manner to effect an exercising movement for each of the user's arms.

Accordingly, the exerciser of the present invention provides in a single device an exerciser that permits a user to perform either a seated pedal-type exercise while simultaneously performing an oscillating arm exercise or a standing elliptical striding exercise while simultaneously performing an oscillating arm exercise. The exerciser is not overly complex or costly as the same feet-engageable moving mechanism is used for both the seated pedal type cycling exercise and the standing elliptical striding exercise.

Other objects, features, and characteristics of the present invention will become apparent upon consideration of the following description and the appended claims with reference to the accompanying drawings, all of which form a part of the specification, and wherein like reference numerals designate corresponding parts in the various figures.

DETAILED DESCRIPTION OF THE PREFERRED EMBODIMENTS

Figure 1:
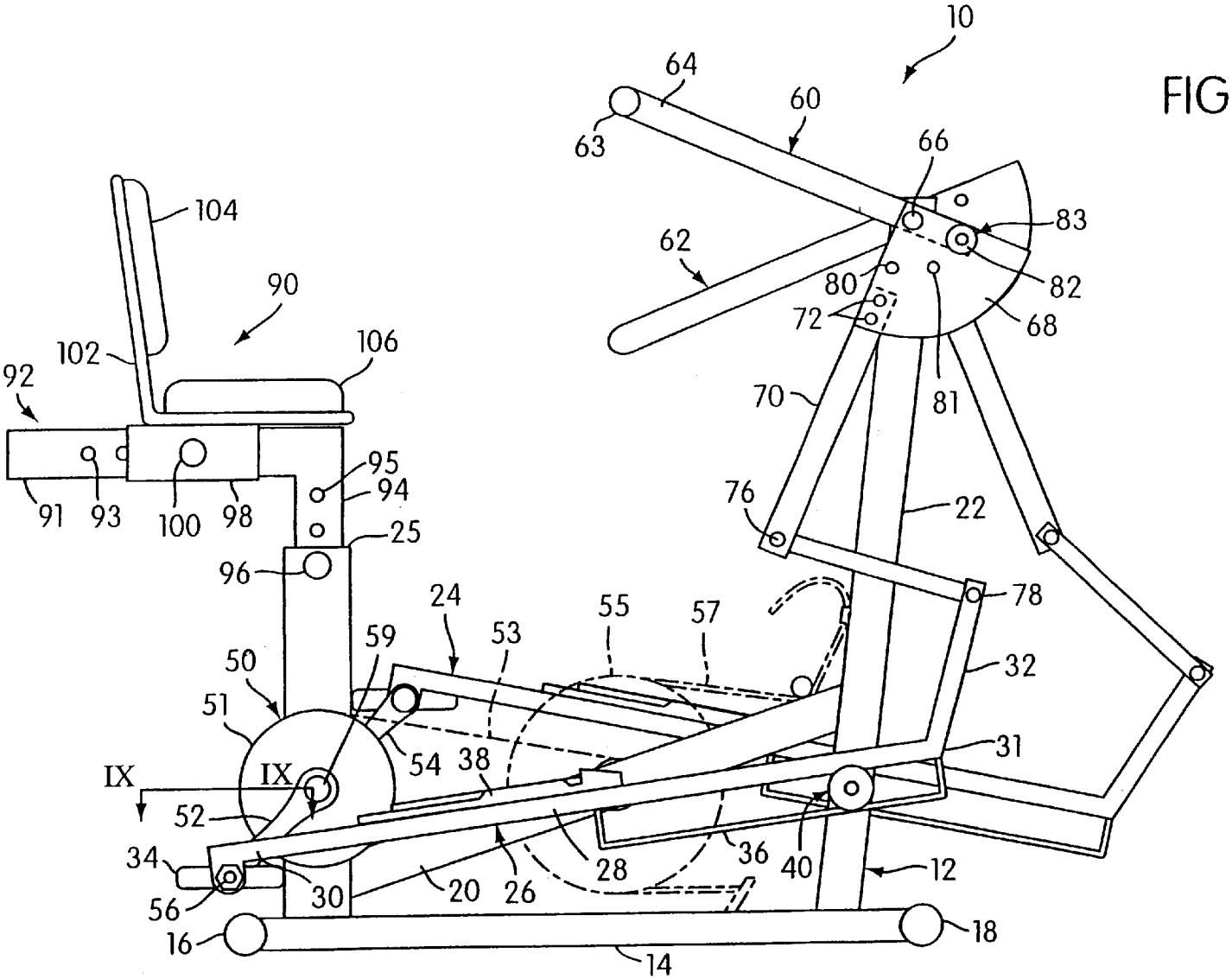
FIG. 1 is a side elevation of the multiple leg movement exercise apparatus of the present invention according to a first embodiment thereof.

A first embodiment of the exercise apparatus of the present invention is generally designated by reference number 10 in FIG. 1. Exercise apparatus 10 includes a frame structure 12 adapted to be supported on a generally horizontal support surface, i.e., the floor. Frame structure 12 includes a longitudinal base member 14 with laterally extending stabilizers 16 and 18 extending transversely across opposite ends of member 14. A forward upstanding post 22 extends upwardly from a forward end of longitudinal base member 14, and a rear upstanding post 17 extends upwardly from a rearward end of the longitudinal base member 14. A cross structure 20 extends between rear post 17 and forward post 22.

A crank mechanism 50 comprises a sprocket 51 rotatably mounted to rear post 17 and radially extending crank arms 52 and 54. The axis of rotation 59 of the crank mechanism 50 defines a transverse axis of the apparatus. Foot engaging pedal members 24 and 26 are coupled to the crank mechanism 50. The apparatus 10 preferably also includes a flywheel assembly including a flywheel 55 rotatably attached to the cross structure 20 of the frame 12. Flywheel 55 is coupled to the crank mechanism 50 by means of a continuous chain 53. A tension strap 57 may be wrapped around the flywheel 55 and the tension of strap 57 may be adjusted to vary resistance to the rotation of the flywheel 55 and thus, the resistance of the system.

The pedal members 24 and 26 are constructed and arranged to be cyclically driven by the legs of a exerciser using the apparatus 10. Alternatively, the pedal members 24, 26 may be motor-driven to actuate the legs of a user whose feet are engaged with the pedal members.

Because the pedal members 24 and 26 are mirror images of one another, only pedal member 26 will be described in detail. Pedal member 26 includes an elongated portion 28 having a rear end 30 and a forward end 31. Pedal member 26 is coupled to the crank mechanism 50 by means of a first coupling portion of the pedal member 26 which provides a journal connection between an axial crank rod 56 extending from the end of crank arm 52 and the rear end 30 of the elongated portion 28.

Pedal member 26 preferably includes an upstanding portion 32 which extends upwardly from the elongated portion 28, preferably at an obtuse angle with respect thereto. In the illustrated embodiment, upstanding portion 32 extends from the forwardmost end 31 of the elongated portion 28. Upstanding portion 32 may, alternatively, extend upwardly from other locations along the elongated portion 28.

In the embodiment of FIG. 1, the forward portion of the pedal member 26 is coupled to the forward post 22 by means of a pedal guide element 40, comprising a roller or slider structure, extending transversely from forward post 22 and engaged by the underside of the elongated portion 28. A roller guide structure 36 is preferably provided beneath the elongated portion 28 and provides a second coupling portion of the pedal member for preventing the pedal member 26 from being separated from the guide element 40.

In the preferred embodiment, pedal member 26 includes an intermediately disposed foot engaging panel 38. Panel 38 may comprise a molded plastic element attached to elongated portion 28 by means of mechanical fasteners, such as screws.

Figure 9:
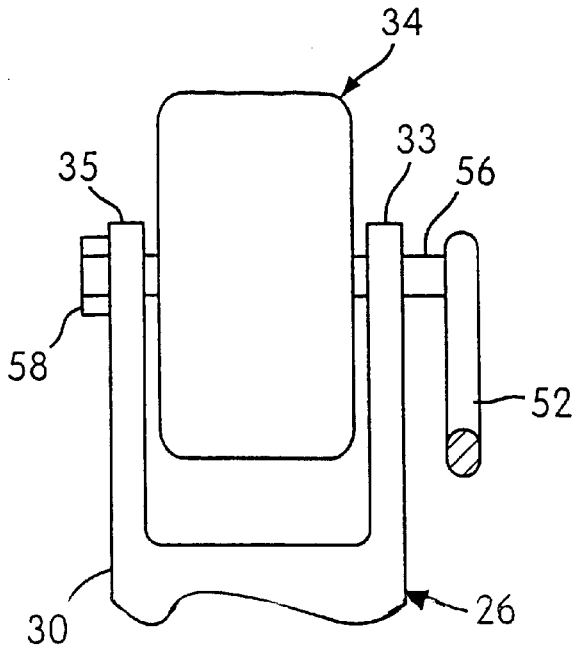
FIG. 9 is a partial section view along section line "IX—IX" in FIG. 1.
Figure 10:
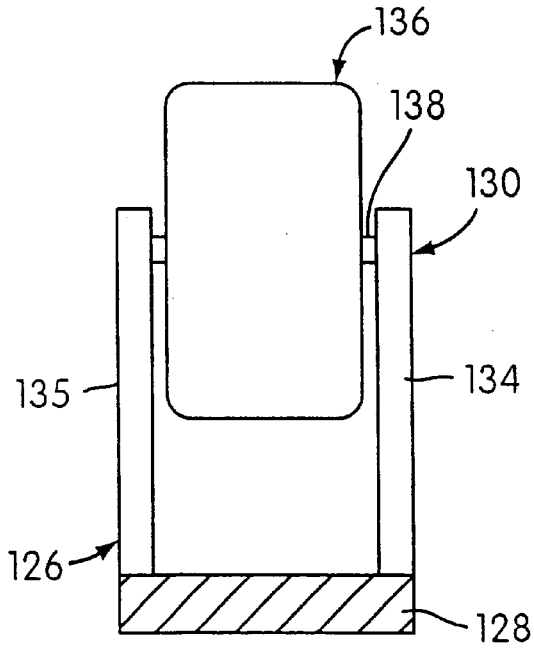
FIG. 10 is a partial section view along section line "X—X" in FIG. 2.

Pedal member 26 may include a rotating pedal element 34 provided at the rear end 30 of the elongated portion 28. As shown in FIG. 9, rotating pedal element 34 is rotatably mounted upon the axial crank rod 56 between arms 33 and 35 on opposite sides of a rectangular cutout 31 at the rear end 30 of the elongated portion 28.

Together, the pedal members 17, 26, the flywheel 55, the crank mechanism 50, and the guide element 40 comprise components of a feet-engageable moving mechanism which can be engaged by the feet of a user and which enables the feet to move in various cyclic paths of motion as will be described below.

The apparatus 10 also preferably includes adjustable oscillating arm assemblies 60, 62. Oscillating arm assemblies 60 and 62 are mirror images of one another, and, therefore, only assembly 60 will be described in detail.

Oscillating arm assembly 60 is pivotally attached to a portion of the frame, such as forward post 22, at a pivot point 66. Arm assembly 60 includes an upper extension 64 having a laterally extending hand engaging portion 63. The arm assembly 60 further includes a lower extension 70. Upper extension 64 and lower extension 70 are coupled to one another by means of a coupling plate 68, preferably in the form of a quadrant of a circle. Lower extension 70 is rigidly fixed to the coupling plate 68 by means of two or more fastener elements 72. Alternatively, lower extension 70 may be welded to coupling plate 68.

Upper extension 64 and coupling plate 68 are both pivotally attached to the forward post 22 at the pivot 66, and upper extension 64 is able to pivot with respect to the coupling plate 68. A number of apertures 80, 81 and 83 are formed in the coupling plate 68 at a given radius from the pivot point 66. The position of the upper extension 64 with respect to the lower extension 70 can be varied by rotating the upper section 64 with respect to the coupling plate 68 and inserting a locking pin 83 through one of the apertures 80, 81 and 83, and an aligned aperture formed in the lower end of upper extension 64.

Oscillating arm assembly 60 is preferably coupled to the pedal member 26 by means of a coupling link 74 pivotally attached at one end 76 to the lower extension 70 and at an opposite end 78 to the upper tip of the upwardly extending portion 32 of the pedal member 26.

Alternatively, oscillating handle arms may be provided which are not operatively coupled to the pedal elements 24 and 26. The arms may be pivotally attached to a portion of the frame so as to be rotatable against an adjustable pivoting resistance as is known in the exerciser arts. In addition, it is not critical that the oscillating handle arms be adjustable to accommodate a seated and a standing user. The oscillating handle arms may include oscillating structures having portions that can be grasped by standing user and portions that can be grasped by a seated user.

Apparatus 10 preferably includes an adjustable seat assembly 90. Seat assembly 90 includes an L-shaped mounting post 92 having a vertical portion 94 and a horizontal portion 91. Vertical portion 94 is telescopically received within an end 25 of the rear post 17. A plurality of apertures 95 are formed through the vertical portion 94, and the height of the seat assembly 90 can be set by means of a locking pin 96 extending through an aperture formed through rear post 17 and through an aligned one of the apertures 95.

A seat 102 is fixed to the top of a sleeve 98 which is slidably received over the horizontal portion 91 of mounting post 92. Seat 102 preferably includes a seat cushion 106 and a back support cushion 104. A plurality of apertures 93 are formed in the horizontal portion 91 of the mounting post 92. The fore and aft position of the seat 102 can be varied by sliding the sleeve 98 over the horizontal portion 91, and the position can be fixed by means of a locking pin 100 extending through an aperture formed in sleeve 98 and one of the apertures 93.

As the pedals are driven by a user or a motor, the rear ends 30 coupled to the crank mechanism 50 travel in a generally circular path about the axis of rotation of the crank mechanism 50. As the rear end 30 of the pedal travels about the crank mechanism, the forward portion is able to slide (and/or roll) and pivot with respect to the guide element 40. The arm assemblies 60, 62, which are coupled to the pedal members 24, 26 oscillate in synchronization to the movements of the pedal member.

An exerciser can stand on the foot engaging panels 38, each of which provides a first foot receiving surface, located on an intermediate portion of the elongated portion 28 of the pedal members 26 and 24. While standing with a generally upright posture upon the pedals, the user can drive the pedal members 26 and 24. Alternatively, the pedals can be motor-driven to cause the user's legs to be moved along with the pedals. As the rear end 30 of the elongated portion 28 traverses a generally circular path and as the forward portion of the pedal member translates and pivots with respect to the guide element 40, the foot engaging panel 38 at the intermediate portion of the elongated portion 28 traverses a generally elliptical path of motion The term generally elliptical path of motion means a noncircular, closed curved path of motion, which, in the preferred embodiments of the present invention, may be elliptical or approximately elliptical, such as oval or egg-shaped. The generally elliptical path of motion traversed by the foot panel 38 simulates the natural stride of a person running or walking.

While driving the pedal member 26 and 24, the user can simultaneously grasp the hand engaging portions 63 of the oscillating arm assemblies 60 and 62 to perform an oscillating arm exercise while assisting in the driving of the pedal members. In FIG. 1, the upper portion 64 of the arm assembly 60 is locked in a downward position in aperture 82 formed in the coupling plate 68. It can be appreciated, however, that for a user performing an exercise while standing on the pedal members 24 and 26, it would be preferable to lock the upper portions 64 of the arm assemblies 60 and 62 in apertures 80 so as to be coextensive with the lower portions 70.

Alternatively, the user can sit on the seat 102 and extend his or her legs forwardly to engage them with second foot receiving surfaces at the upwardly extending portions 32 of the pedal members 26 and 24. With the user's feet bottoms engaged with the upwardly extending portions 32 having a vertical component, the user can alternately extend each leg in a leg extension stroke and exert forces on the pedal members 26 and 24 having horizontal components. Thus, the user can drive the pedal members 26 and 24 to perform what is commonly known as a recumbent cycling exercise. Because of the forward position of the upwardly extending portions 32 with respect to the seat 102, each of the user's legs is maintained so that the foot is always forward of the knee of that leg during each cycle of leg movement including the leg extension stroke and a leg return stroke. The seat 102 can be appropriately adjusted to accommodate the recumbent position, and the oscillating arm assemblies 60 and 62 can be appropriately adjusted and can be grasped to perform arm exercises while assisting in the driving of the pedal members 26 and 24.

The user can also sit on the seat 90 and place the bottoms of his or her feet on third foot receiving surfaces at the rear portions 30 of the pedal members 24 and 26. From the seated position, the user can drive the pedal members 24 and 26 by alternately extending each leg in a downward stroke to exert forces having vertical components to the pedal members 24, 26. While driving the pedal members from the third foot receiving surfaces at the rear portions 30, the user's feet will traverse a generally circular path about the axis of rotation of the crank mechanism 50 during cycles of leg movements which include the downward stroke and upward strokes. Preferably, the pedal members 24 and 26 are equipped with rotatable pedal members 34, which provide the third foot receiving surfaces, thus permitting the user's feet to maintain a generally constant orientation while they traverse the generally circular path, as when riding a stationary bicycle. The height of the seat 102 and the fore and aft position of the seat 102 can be adjusted so as to accommodate the cycling exercise. In addition, the user can simultaneously grasp the hand engaging portion 63 of the oscillating arm assemblies 60 and 62 to perform an arm exercise while assisting in driving the pedal members 24, 26.

Figure 2:
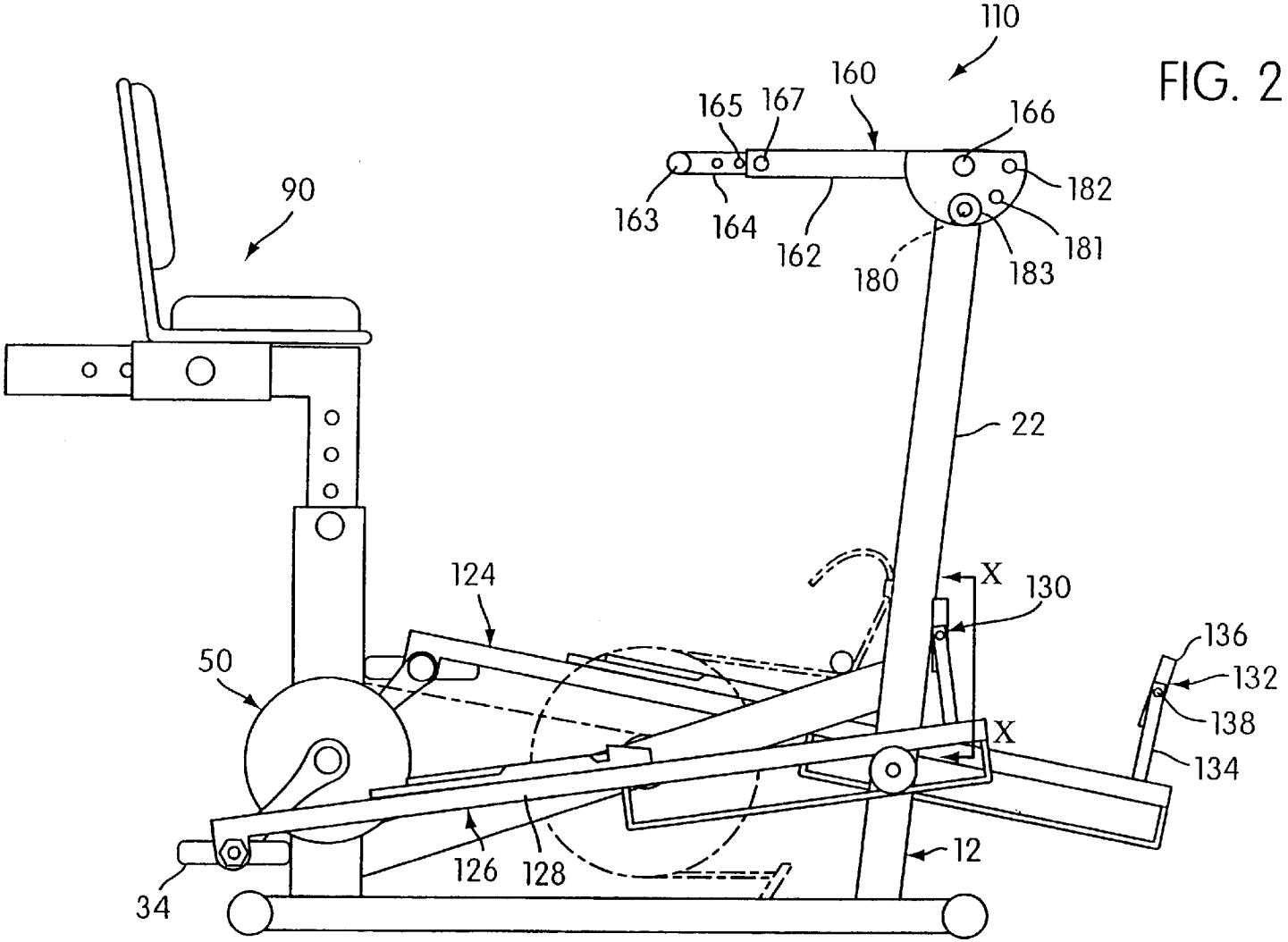
FIG. 2 is a side elevation of the multiple leg movement exercise apparatus of the present invention according to a second embodiment thereof.

A second embodiment of the exercise apparatus of the present invention is designated generally by reference number 110 in FIG. 2. Apparatus 110 is in many respects identical to apparatus 10 shown in FIG. 1, and common components will be labeled with identical reference numbers. FIG. 2 illustrates an alternate, non-oscillating adjustable arm assembly 160. Arm assembly 160 includes an upper extension 162 attached to an adjustment plate 168 that is pivotally attached at 166 to the forward post 22. Adjustment plate 168, preferably in the form of a semi-circle, includes a plurality of apertures 180, 181, 182 disposed at a fixed radius from pivot point 166. The orientation of the upper extension 162 can be varied by pivoting the arm about the pivot point 166 and inserting a locking pin 183 through one of the apertures 180, 181, 182 and an aligned aperture formed through the forward post 22. Upper extension 162 includes a hand engaging portion 163 at the end opposite pivot point 166, and upper extension 162 may also include a telescoping portion 164. Telescoping portion 164 includes a plurality of apertures 165 so that the overall length of the upper extension 162 can be varied by sliding telescoping portion 164 in or out and inserting a locking pin 163 through an aperture formed in the stationary portion of upper extension 162 and an aligned one of the apertures 165 formed in the telescoping portion 164. Accordingly, the position of the hand engaging portions 163 can be varied to accommodate users of different sizes and to accommodate users performing different exercises on the apparatus 110.

Another alternative to the hand engaging assemblies shown in FIGS. 1 and 2 is a fixed, nonadjustable handle structure having portions thereof positioned to be grasped by a standing user and portions thereof positioned to be grasped by a seated user.

FIG. 2 also shows alternate foot engaging structures at 130, 132 for providing the second foot receiving surfaces for performing recumbent cycling exercises. Structures 130, 132 include two rigid brace members 134, 135 extending upwardly from elongated portion 128. A rotatable pedal member 136 is journally supported on a shaft 138 spanning the brace members 134, 135. The foot engaging structures 130, 132 can be engaged by a user on the seat assembly 90 with his or her legs extending forwardly. The pedal members 130 and 132 are arranged to permit a user to extend his or her legs during an extension stroke to exert a force having a substantial horizontal component to drive the pedal members 126 and 124. The rotating pedal member 136 permits the users foot to remain in a substantially constant orientation throughout cycles of leg movements including extension and return strokes.

Figure 3:
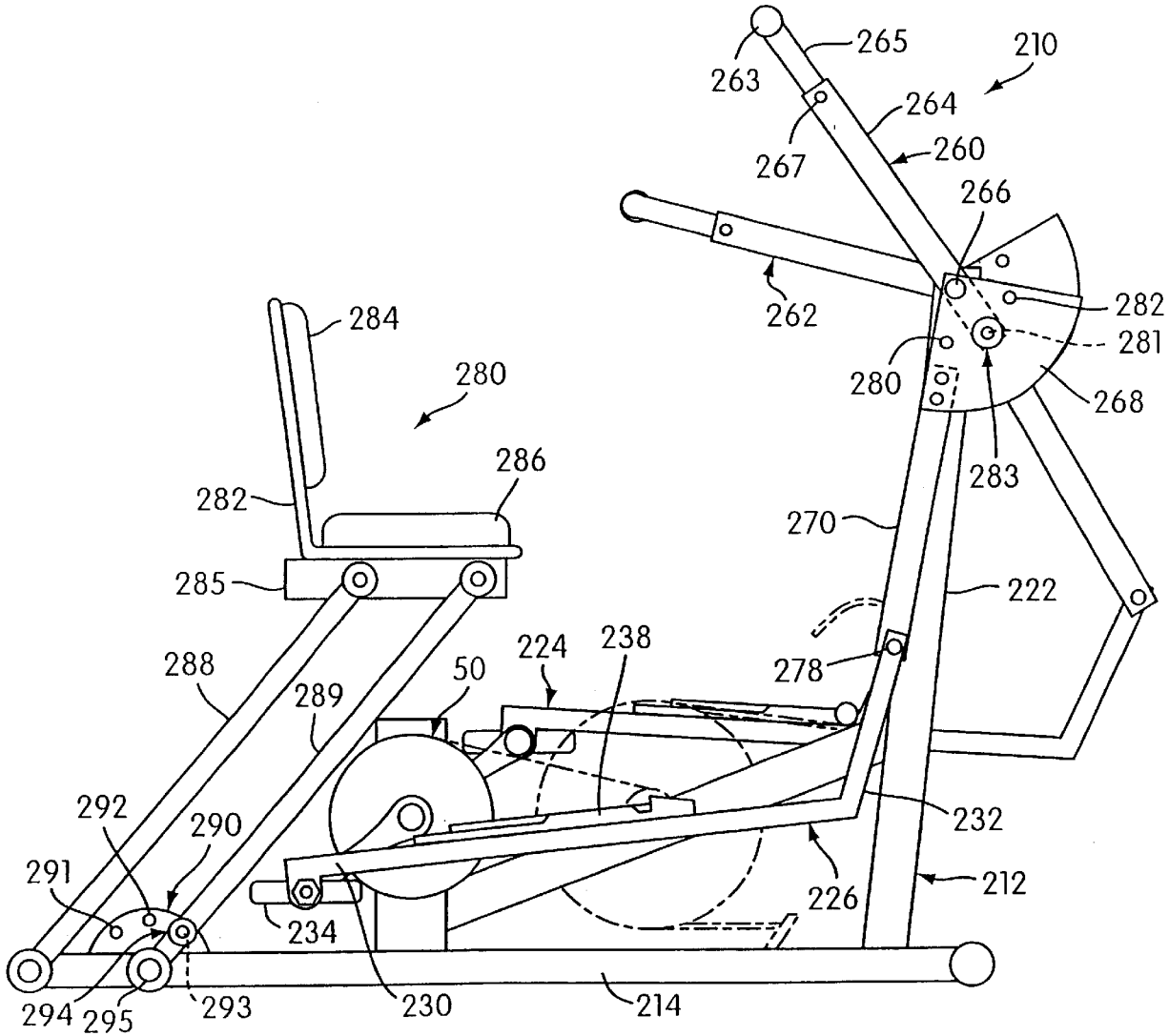
FIG. 3 is a side elevation of the multiple leg movement exercise apparatus of the present invention according to a third embodiment thereof.

A third embodiment of the exercise apparatus of the present invention is designated generally by reference number 210 in FIG. 3. Apparatus 210 includes a frame structure 212 having a longitudinal base member 214, a forward upstanding post 222, and a rear upstanding post 217 on which a crank mechanism 50 is rotatably mounted. Pedal members 224 and 226 are coupled at their rear ends to the crank mechanism 50 in the manner described above with respect to pedal members 24 and 26 of FIG. 1. Pedal members 224 and 226 are mirror images of one another. Therefore, only pedal member 226 will be described in detail.

Pedal member 226 includes an elongated portion 228 with an upstanding portion 232 extending from a forward end of the elongated portion 228. As with the embodiment of FIG. 1, the upstanding portion 232 preferably extends upwardly at an obtuse angle with respect to the elongated portion 228. Pedal member 226 further includes an intermediate foot receiving panel 238.

The forward portion of the pedal member 226 is coupled to the frame 212 by means a lower extension 270 of an oscillating arm assembly 260 which is pivotally attached to the pedal member 226 at pivot point 278 and is pivotally attached to the frame 212 at pivot point 266.

As the pedal member 226 is driven by a user or motor, the rear end travels about the axis of rotation of crank mechanism 50 in a generally circular path and the forward portion of the pedal member 226 is directed along an arcuate oscillating path by the pivoting lower extension 270 of the oscillating arm assembly 260. The intermediate portion of pedal member 226, at foot engaging platform 238, travels in a generally elliptical path of motion simulating the stride of a walking or running person. Accordingly, the lower extensions 270 of the oscillating arm assemblies 260, 262 act as reciprocal guiding mechanisms for directing the forward ends of the pedal members 224, 226 along oscillating, reciprocal paths of motion (i.e., the same path is traveled forward and backward) as the rear ends of the pedal members traverse generally circular paths of motion, as disclosed in U.S. Pat. Nos. 5,242,343 and 5,383,829, the disclosures of which are hereby incorporated by reference.

Oscillating arm assemblies 260 and 262 preferably also include a position adjusting mechanism as described above and shown in FIG. 1. That is, arm assembly 260 includes an upper extension 264 coupled to the lower extension 270 by means of a coupling plate 268. Lower extension 270 is rigidly attached to the coupling plate 268 by any suitable means such as mechanical fasteners or welding. Both the upper extension 264 and the coupling member 268 are pivotally attached at 266 to the forward post 222, and the orientation of the upper extension 260 can be varied by pivoting the upper extension 264 with respect to the coupling plate 268 and inserting a locking pin 283 into one of the apertures 280, 281, 282 aligned with an aperture formed in the lower end of upper extension 264.

Upper extension 264 may also include a telescoping portion 265 having a transverse hand engaging portion 263 at its upper end. Telescoping portion 265 can be locked into a desired position by means of a pin 267 extending through an aperture formed in the stationary portion of upper extension 264 aligned with one of a plurality of apertures formed in telescoping portion 265.

FIG. 3 also shows an alternate seat assembly 280. Seat assembly 280 includes a seat 282 having a seat cushion 286 and a back support cushion 284. Seat 282 is attached to the top of a frame element 285. The seat 282 and frame element 285 are secured to the base frame member 214 of the frame structure 212 by means of a four bar linkage (only two of the bars 288 and 289 of the four bar linkage are shown in FIG. 3). The height of the seat 282 and its fore and aft position with respect to pedal members 224, 226 can be adjusted by rotating the four bar linkage which maintains the seat in a level position at all orientations of the linkage.

A gusset plate 290 is mounted to base member 214 adjacent one of the links, e.g., link 289, of the four bar linkage for locking the seat assembly 280 into a desired position. The gusset plate 290 includes a number of apertures, such as apertures 291, 292, 293, formed therethrough at a constant radius from the pivoting connection 295 of the link 289 to member 214. A pin 292 can be inserted through one of the apertures formed in the gusset plate and through an aligned aperture formed in the lower end of link 289.

Seat assembly 280 or seat assembly 90, shown in FIG. 1, could be interchanged in any of the embodiments shown herein.

As with the forgoing embodiments, the user of apparatus 210 can stand on the pedal member 224, 226 with one foot placed on each of the foot receiving panels 238 of the pedal members 224, 226 and drive the pedal members (or follow motor driven pedals) with the feet moving in generally elliptical paths of motion to simulate a walking or running stride. In addition, the hand engaging members 263 of the pivoting arm assemblies 260 and 262 can be grasped and oscillated to exercise the arms, while assisting in the driving of the pedals.

The seat assembly 280 can be adjusted into a lowered, forward position, such as shown in FIG. 3 and a user seated thereon can extend his or legs to engage the upwardly extending portions 232 of the pedal members 224, 226. By alternately extending each of the legs in leg extension strokes, forces having substantial horizontal components can be applied to the pedal members 224 and 226 to thereby drive the pedal members. As an alternative to the fixed upwardly extending portions 232 of the pedal member 226, rotatable foot engaging member, such as members 130 and 132 shown in FIG. 2, could be provided on the pedal members 224, 226, with the lower extensions 270 of the pivoting arm assemblies 260 coupled thereto.

Figure 4:
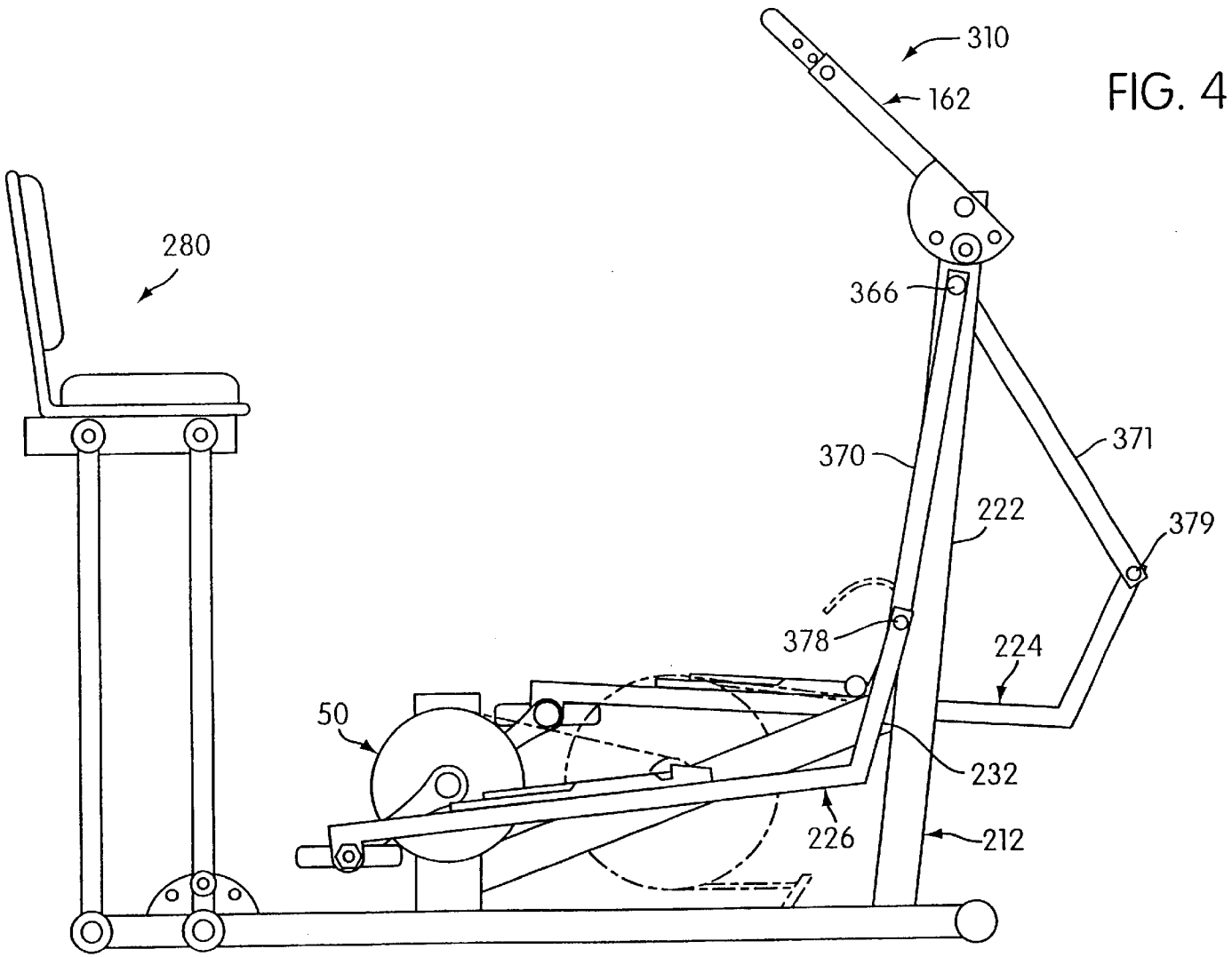
FIG. 4 is a side elevation of the multiple leg movement exercise apparatus of the present invention according to a fourth embodiment thereof.

The seat assembly 280 can be moved to an upright, rearwardly disposed position, such as shown in FIG. 4, and the pedal members 224 and 226 can be engaged by the users feet at the respective rear ends 230 thereof. The exerciser can then drive the pedal members 224 and 226, with his or feet traveling in a generally circular path about the axis of rotation of the crank assembly 50. Preferably, each of the pedal members 224 and 226 includes a rotatable pedal member 34, so that the user's feet can be maintained in a generally constant orientation while driving the pedal members.

A fourth embodiment 310 of the exercise apparatus of the present invention is shown in FIG. 4. Apparatus 310 is similar to apparatus 210 shown in FIG. 3, but, instead of oscillating arm assemblies 260, 262, apparatus 310 includes an adjustable, non-oscillating arm assembly 162, such as that shown in FIG. 2 and described above. Pedal members 224 and 226 are supported on the frame 212 and guided during their respective motions by pivoting members 370 and 371, which are pivotally attached to the forward post 22 at pivot point 366 and attached to the pedal members 224 and 226 at points 379 and 378, respectively.

As an alternate reciprocal guide mechanism to the pedal guide mechanisms shown in FIGS. 3 and 4 whereby the forward portions of the pedals are supported by pivoting members and directed along arcuate oscillating paths of motion, the forward portions of the pedal members 224 and 226 could be directed along track structures which are supported by the frame 212. The track structures may be straight and level, straight and inclined, or arcuate in shape. Each pedal member 224, 226 would include a roller element for engaging the track structure so that the forward portion of the pedal member travels reciprocally back and forth along the track structure as the rear portion travels about the crank mechanism 50. Such pedal guide mechanisms are disclosed in previously incorporated U.S. Pat. Nos. 5,242,343 and 5,383,829.

Figure 5:
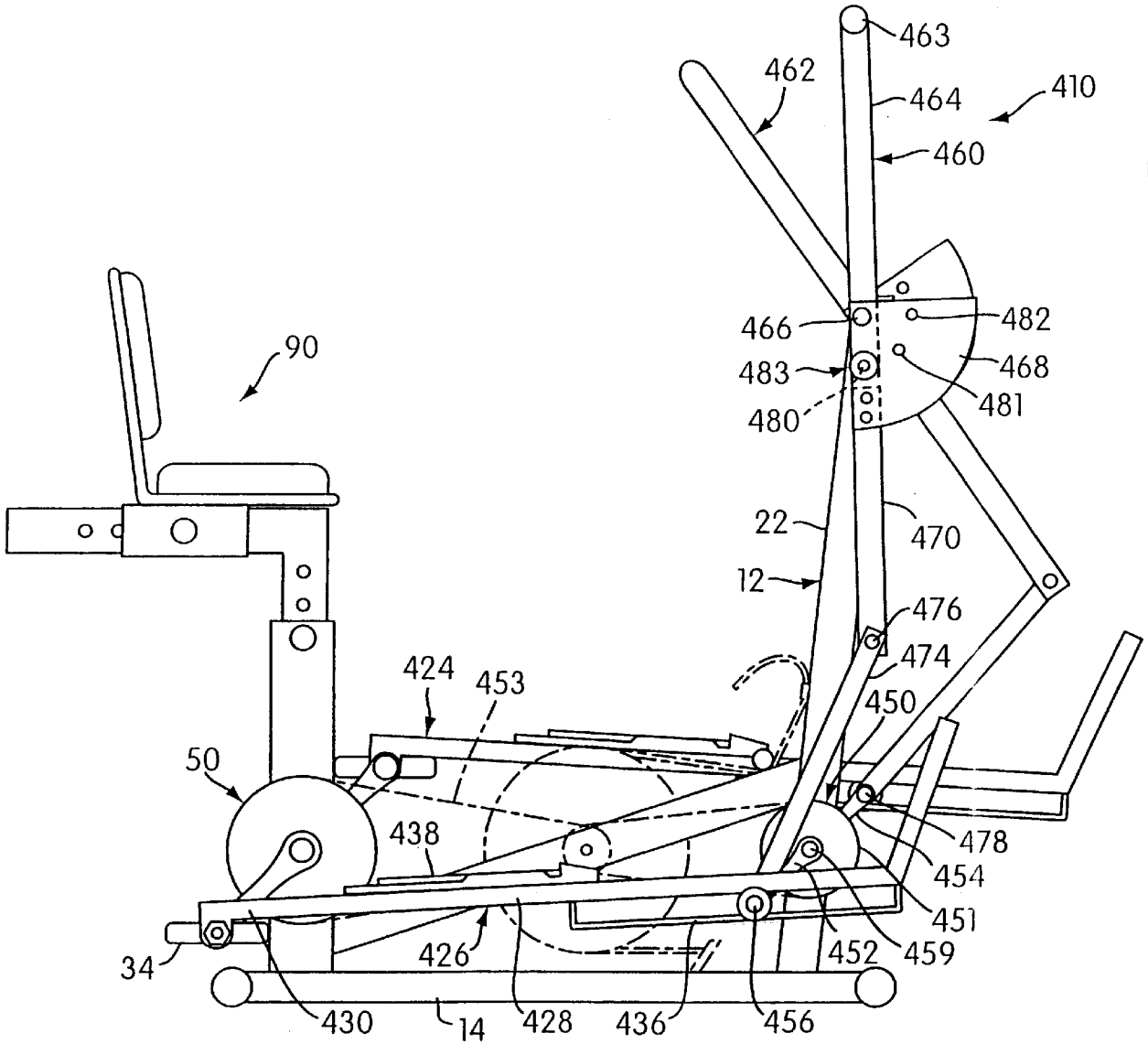
FIG. 5 is a side elevation of the multiple leg movement exercise apparatus of the present invention according to a fifth embodiment thereof.

A fifth embodiment of the exercise apparatus is designated generally by reference number 410 of FIG. 5. The apparatus illustrated in FIG. 5 includes frame 12 having longitudinal base member 14 and a forward post 22 and rear post 17, as with the first embodiment as shown in FIG. 1 and described above. Apparatus 410 further includes an adjustable seat mechanism 90 coupled to the rear post 17 and a crank mechanism 50 rotatably attached to the rear post 17. Pedal members 424 and 426 are operatively coupled to the frame 12 so as to be driven by a user performing a leg exercise on the apparatus 410. Pedal members 424 and 426 are mirror images of one another, and, therefore, only pedal member 426 will be described in detail.

Pedal member 426 includes elongated portion 428 coupled at a rear end 430 coupled the crank mechanism 50 as described above with respect to pedal member 26 and crank mechanism 50 shown in FIG. 1. Pedal member 426 preferably also includes a rotating pedal element 34 coupled to both the elongated portion 428 and the crank mechanism 50.

An upstanding portion 432 extends upwardly from the elongated portion 428 at an obtuse angle with respect to the elongated portion 428. Upstanding portion 432 enables a user sitting on the seat assembly 90 to extend his or her legs in a forward leg extension stroke and engage the upstanding portion 432 with his or her feet to perform a recumbent exercise by exerting forces having substantial horizontal components as described above.

A forward portion of the pedal member 426 is supported on the frame 12 and is guided through its path of motion by a forward crank mechanism 450 rotatably attached to the forward post 22 to rotate about its axis of rotation 459 which defines a second transverse axis. Crank mechanism 450 includes a sprocket 451 and radially extending cranks 452, 454. An axially extending crank rod 456 extends from the outermost end of crank arms 452, 454. Pedal member 426 is supported by the crank mechanism 450 by virtue of the elongated portion 428 resting upon the crank rod 456.

The forward crank mechanism 450 and the rear crank mechanism 50 are coupled to one another by means of a continuous chain 453. Forward crank mechanism 450 is preferably of a smaller diameter than rear crank mechanism 450, and, therefore, as the pedal 426 is actuated, the rear end 430 thereof travels in a generally circular path about the axis of rotation of the crank mechanism 50 and the forward mechanism 450 rotates out of phase with respect to the rear crank mechanism 50. Accordingly, the pedal member 426 must be able to translate fore and aft with respect to the crank rod 456 to accommodate this out-of-phase movement. Preferably, crank rod 456 is covered with a roller or slider element to facilitate translation of pedal member 426 with respect to the crank rod 456. A guide track 436 is preferably provided on the underside of the elongated portion 428 of pedal member 426 to ensure that the pedal member 426 does not become separated from the crank rod 456. Because of the smaller size of the forward crank mechanism 450 and the resulting out-of-phase movement thereof, while the rear portion 430 of the pedal member 426 traverses a generally circular path about the axis of rotation of the rear crank mechanism 50, portions of the pedal member 426 forward of the rear portion 430 traverse generally elliptical paths increasing in length closer to the forward end of the pedal member 426.

Apparatus 410 preferably also includes adjustable oscillating arm assemblies 460 and 462 coupled to the pedal members 426 and 424, respectively. Because arm assemblies 460 and 462 are mirror images of one another, only assembly 460 will be described in detail.

Arm assembly 460 includes a downward extension 470 coupled to the crank arm 452 of the forward crank assembly 450 by means of a link 474. Link 474 is coupled to the lower extension 470 at pivot point 476 and is coupled to the crank arm 452 at a pivot point such as pivot point 478 shown on the opposite arm assembly 462.

Alternatively, the lower extension 470 could be coupled by means of a pivoting link to a portion of the pedal member 426 such as the upper tip of the upwardly extending portion 432 such as shown in FIG. 1 with respect to the first embodiment.

Arm assembly 460 further includes an upward extension 464 having a transverse hand-engaging portion 463. Upward extension 464 may be adjustable by means of a telescoping member such as shown in FIG. 3 and described above.

Upper extension 464 and lower extension 470 are coupled to one another by means of a coupling plate 468. Both the upper extension 464 and the coupling plate 468 are pivotally attached to the forward post 22 at pivot point 466. Lower extension 470 is rigidly attached to the coupling plate 468 by any suitable means such as mechanical fasteners or welding, and upper extension 464 is rotatable with respect to the coupling plate 468. Upper extension 464 can be secured into one of a plurality of desired positions by inserting a pin 483 through one of the apertures, such as apertures 480, 481, 482, formed in the coupling plate 468 and aligned with an aperture formed through the lower end of the upper extension 464.

As with the previous embodiments, a user can perform a striding exercise by standing with his or her feet based on the foot-engaging panels 438 and driving the pedal members 426 and 424 in a generally circular paths while simultaneously oscillating the handles, adjusted to an appropriate position.

Alternatively, the user can perform a cycling exercise while seated in seat 90 with his or her feet engaged with the rear ends 430 of the pedal members 426 and 424, or the user can perform a recumbent cycling exercise by extending his or her legs forward to engage his or her feet with the upwardly extending portions 432 of the pedal members 426 and 424.

The dual crank system comprising rear crank mechanism 50 and forward crank mechanism 450 for supporting and guiding the pedal members 424 and 426 is similar to a mechanism disclosed in U.S. Pat. No. 4,786,050 the disclosure of which is hereby incorporated by reference.

Figure 6:
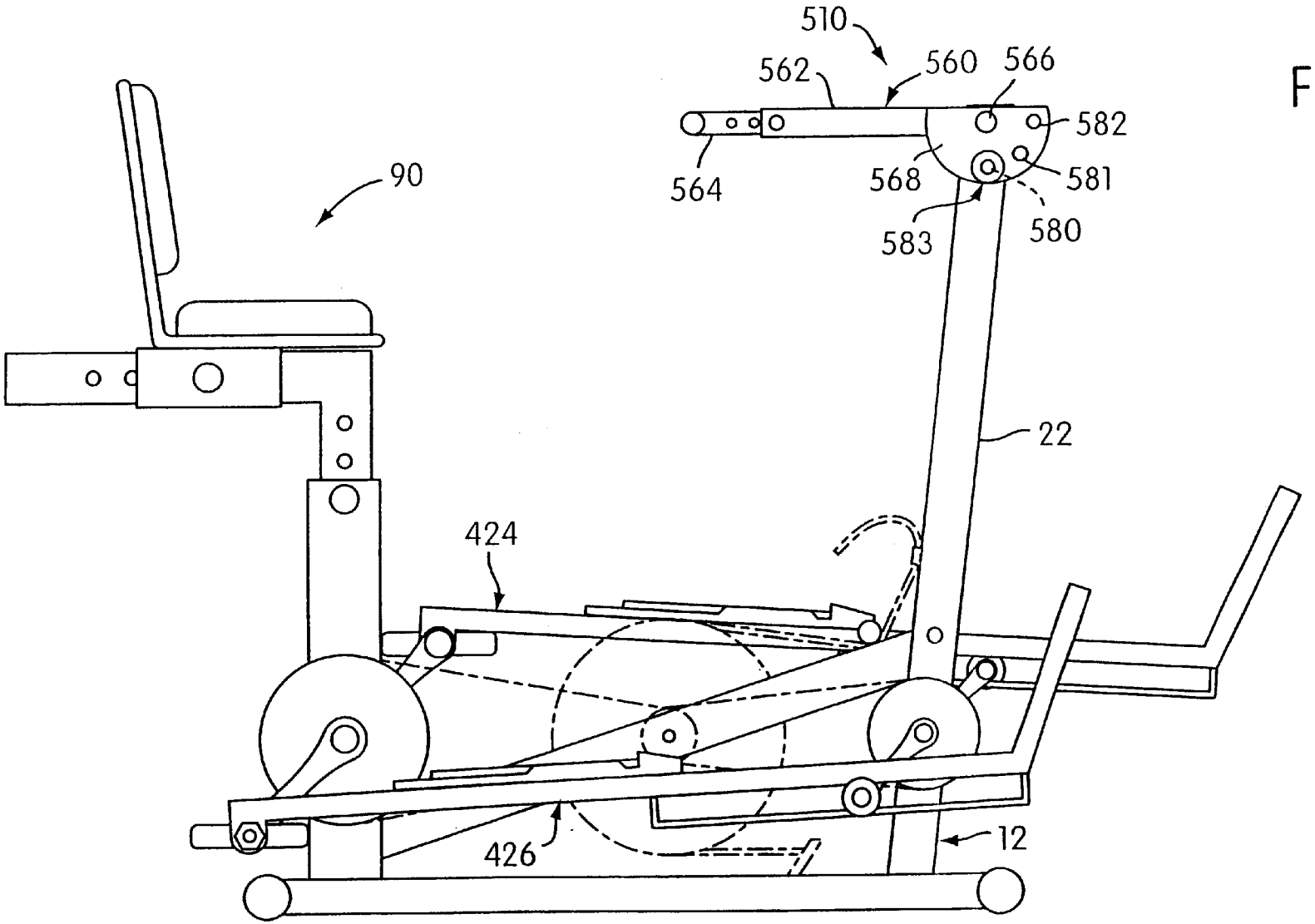
FIG. 6 is a side elevation of the multiple leg movement exercise apparatus of the present invention according to a sixth embodiment thereof.

A sixth embodiment of the exercise apparatus of the present invention is designated generally by reference number 510 shown in FIG. 6. Apparatus 510 is in most respects similar to apparatus 410 shown in FIG. 5, except that it does not include oscillating arm assemblies coupled to the pedal members 424 and 426. Instead, apparatus 510 includes an adjustable fixed arm assembly 562 pivotally coupled to forward post 22 at pivot point 566. Adjustable arm assembly 562 includes an adjustment plate 468 having a plurality of apertures, such as apertures 580, 581, and 582, formed therethrough which permit the position and orientation of the upper extension 462 to be varied by means of inserting a locking pin 583 through a selected one of the apertures aligned with an aperture formed through the forward post 22. Upper extension 562 may also include a telescoping portion 564 permitting further adjustment of the assembly 560.

Figure 7:
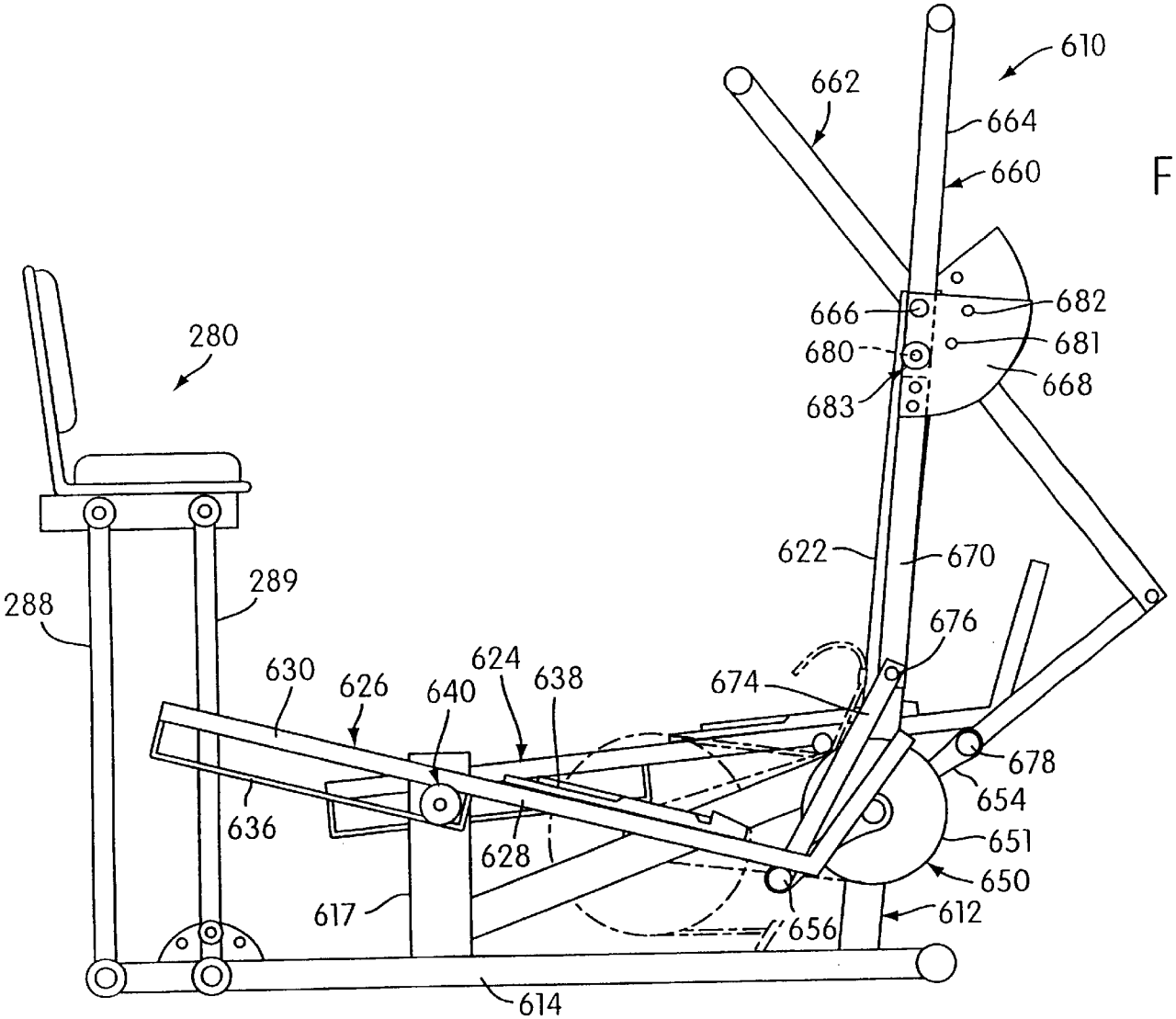
FIG. 7 is a side elevation of the multiple leg movement exercise apparatus of the present invention according to a seventh embodiment thereof.

A seventh embodiment of the present invention is designated generally by reference number 610 in FIG. 7. Apparatus 610 includes a frame 612 having a longitudinal base member 614, a forward post 622 and a rear post 617 similar to the frame 212 shown in FIG. 3 and described above. Apparatus 610 further includes a seat assembly 280 adjustable by virtue of a four bar linkage represented by two of the links 289 and 288 similar to the seat assembly 280 described above with respect to FIGS. 3 and 4.

Apparatus 610 includes pedal members 624 and 626. Because pedal members 624 and 626 are mirror images of one another, only pedal member 626 will be described in detail. Pedal member 626 includes an elongated portion 628 having a rear end 630 and an upwardly extending portion 632 extending up at an angle obtuse from a forward portion of the elongated portion 628.

A forward portion of the elongated portion 628 is coupled to the frame 612 by means of a forward crank assembly 650. Crank assembly 650 includes a sprocket 651 rotatably carried by the forward post 622 and radially extending crank arms 652 and 654. Each crank arm includes an axially extending crank rod 656 coupled to a forward portion of the pedal member 626 by a journal connection. The rear portion 630 of the pedal member 624 is rollably and/or slidably engaged with a fixed guide member 640 carried by the rear post 617 of the frame 612. Pedal member 624 includes a guide track assembly 636 to prevent the pedal member 624 from becoming separated from the guide member 640.

Pedal member 626 preferably also includes an intermediate foot-engaging panel 638. As the pedal members 624 and 626 are driven in a cyclic manner, the forward ends thereof traverse a generally circular path about the axis of rotation of the crank mechanism 650, and the rear ends thereof translate and pivot with respect to the fixed guide member 640. Thus, an intermediate portion of the elongated portion 628 traverses a generally elliptical path of motion which simulates a striding motion of a walking or running person.

Apparatus 610 also includes adjustable oscillating arm assemblies 660 and 662. The arm assemblies 660 and 662 are mirror images of one another, and therefore, only arm 660 will be described in detail. Arm assembly 660 pivots with respect to the frame at a pivot point 666 extending through the forward post 622. A lower extension 670 extends downwardly and is coupled to the pedal members by means of a link 674 extending between a first pivot point 676 and a second pivot point, such as pivot point 678 shown on assembly 662. Alternatively, lower extension 670 may be coupled directly to the pedal member by means of a link extending between an end of the lower extension 670 and a portion of the pedal member 628, for example the upper tip of the upwardly extending portion 632, such as shown in the embodiment of FIG. 1.

Arm assembly 660 includes an upper extension 664 extending up from the pivot point 666. Upper extension 664 and lower extension 670 are coupled to one another by a coupling plate 668. The lower extension 670 is rigidly attached to the coupling plate 668 and the upper extension 664 is able to rotate with respect to the plate 668. The angular position of the upper extension 664 is adjustable by means of a pin 683 extending through an aperture, such as one of the apertures 680, 681, and 682, formed through the plate 668 and an aligned aperture formed in a lower end of upper extension 664. Upper extension 664 may also include a telescoping portion to provide additional adjustability as described above.

Apparatus 610 permits an exerciser to perform two pedal-type exercises thereon. An exerciser can stand in a generally upright posture on the foot-engaging panel 638 and perform a striding exercise by actuating the pedal members 624 and 626 to move his or her feet in a generally elliptical path simulating a natural foot stride. The user may simultaneously grasp each of the arm assemblies 660 and 662 to perform arm exercises therewith while assisting in the actuation of the pedal members 624 and 626.

Alternatively, the user can adjust the seat assembly 280 as necessary and, while seated thereon, extend his or her legs to engage his or her feet with the upwardly extending portion 632. The user can then actuate the pedals by exerting a force having a substantial horizontal component and drive the pedal members 624 and 626, the user's feet traversing a generally circular path about the axis of rotation of the crank mechanism 650, to perform a recumbent cycling exercise. Again, the user can simultaneously actuate the arm assemblies 660 and 662 to perform an arm exercise while assisting in the actuation of the pedal members.

Figure 8:
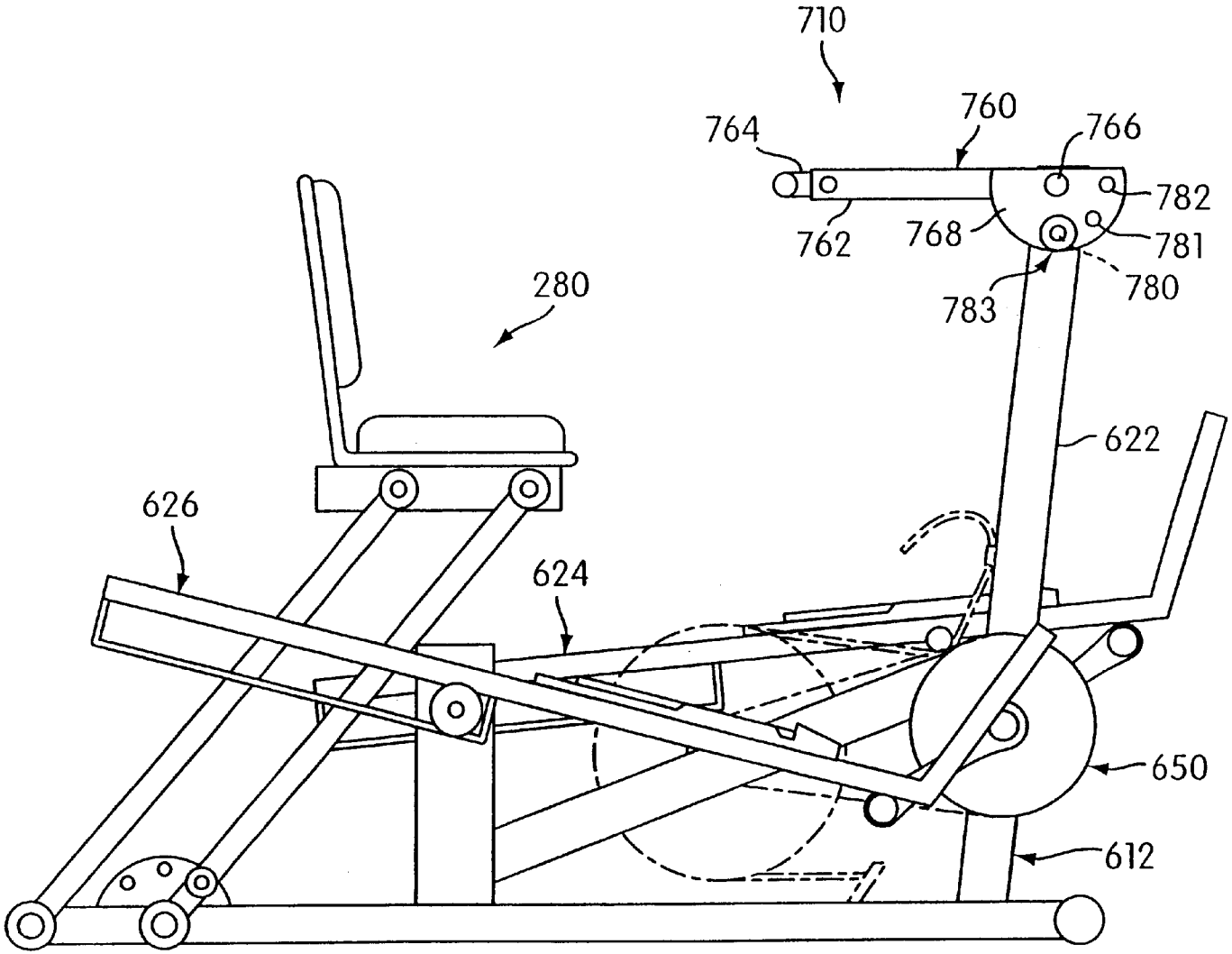
FIG. 8 is a side elevation of the multiple leg movement exercise apparatus of the present invention according to a eighth embodiment thereof.

An eighth embodiment of the exercise apparatus 710 of the present invention is shown in FIG. 8. Apparatus 710 is in most respects identical to the apparatus 610 described above and shown in FIG. 7, except that it does not include oscillating arm assemblies coupled to the pedal members 624 and 626. Instead, apparatus 710 includes a non-oscillating adjustable arm assembly 760 having an upper extension 762 attached to an adjustment plate 768 which is pivotally attached to forward post 622 at pivot point 766. Adjustment plate 768 has a plurality of apertures formed therethrough, such as apertures 780, 781, and 782, through which a pin 783 may be inserted into an aligned hole formed in the forward post 622 to adjust the orientation of the assembly 760. Upper extension 762 may further include a telescoping portion 764 to provide additional adjustability as described above.

While the invention has been described in connection with what is presently considered to be the most practical and preferred embodiments, it is to be understood that the invention is not to be limited to the disclosed embodiment, but, on the contrary, it is intended to cover various modifications and equivalent arrangements included within the spirit and scope of the appended claims. Thus, it is to be understood that variations in the particular parameters used in defining the present invention can be made without departing from the novel aspects of this invention as defined in the following claims.

What is claimed is:

1. A multi-purpose exercise apparatus comprising:

a frame structure constructed and arranged to be supported on a generally horizontal surface;

a seat mounted on said frame structure for supporting a user seated thereon; and a feet engageable moving mechanism carried by said frame structure and constructed and arranged to be operated by the legs of a user, said feet engageable moving mechanism presenting:

(1) first foot receiving surfaces positioned on said feet engageable moving mechanism to support a user standing thereon with a generally upright posture, said first foot receiving surfaces being constructed and arranged to enable each of the user's feet to move in generally elliptical cycles of movement simulating cycles of striding foot movements by the user's feet supported thereon; and (2) second foot receiving surfaces spaced further from said seat than said first foot receiving surfaces, said second foot receiving surfaces having a vertical component enabling the user to engage said second foot receiving surfaces with a bottom portion of the user's feet while seated on aid seat and to alternately extend each of the user's legs during leg extension strokes thereof to apply a substantially horizontal force component to said second foot receiving surfaces with the bottom portion of the user's feet to drive said feet engageable moving mechanism against an internal resistance of said feet engageable moving mechanism, said second foot receiving surfaces being positioned on said feet engageable moving mechanism such that each of the user's legs has the foot thereof maintained forwardly of the knee thereof throughout a range of leg movement including a portion of said leg extension strokes thereof and a portion of leg return strokes thereof.

2. The multi-purpose exercise apparatus of claim 1, said feet engageable moving mechanism further presenting third foot receiving surfaces spaced closer to said seat than said first foot receiving surface, said third foot receiving surfaces having a horizontal component enabling the user to engage said third foot receiving surfaces with the bottom portion of the user's feet while seated on said seat and to alternately extend each of the user's legs during generally downward leg strokes thereof to apply a substantially vertical force component to said third foot receiving surfaces with the bottom portion of the user's feet to drive said feet engageable moving mechanism against the internal resistance of said feet engageable moving mechanism, said feet engageable moving mechanism being constructed and arranged to cause each of the user's feet to move in a generally circular path of motion during a range of leg movement including said generally downward leg strokes and generally upward leg strokes.

3. The multi-purpose exercise apparatus of claim 1 further comprising a hand grip assembly mounted on said frame structure and constructed and arranged to accommodate the hands of a user standing with a generally upright posture on said first foot receiving surfaces and the hands of a user seated on said seat while engaging a one of said second foot receiving surfaces and said third foot receiving surfaces.

4. The multi-purpose exercise apparatus of claim 3, said hand grip assembly comprising an adjustable hand grip structure constructed and arranged to be moveable between a position accommodating the hands of a user standing with a generally upright posture on said first foot receiving surfaces and one or more positions accommodating the hands of a user seated on said seat while engaging a one of said second foot receiving surfaces and said third foot receiving surfaces.

5. The multi-purpose exercise apparatus of claim 3, said hand grip assembly comprising a pair of hand-engaging members pivotally carried on said frame structure and constructed and arranged to oscillate toward and away from the user to enable the user to grasp each of said pair of hand-engaging members and effect an upper body exercise by alternately moving his arms toward and away from himself to move the hand-engaging members.

6. The multi-purpose exercise apparatus of claim 5 wherein each of said pair of hand-engaging members is operatively coupled with said feet engageable moving mechanism to cause said pair of hand-engaging members to oscillate in synchronization with a movement of said feet engageable moving mechanism.

7. The multi-purpose exercise apparatus of claim 1, said feet engageable moving mechanism comprising:

a generally horizontal transverse axis carried on said frame structure;

a pair of elongated pedal members, each having a first and a second coupling portion;

a pedal coupling member associated with the first coupling portion of each elongated pedal member for pivotally coupling said first coupling portion to said transverse axis at a radial distance therefrom so that said first coupling portion traverses a generally circular path of motion about said transverse axis; and a pedal guide mechanism supported by said frame structure and constructed and arranged to be engaged by said second coupling portion of each of said elongated pedal members and to direct said second coupling portion along a prescribed path of motion as said first coupling portion traverses said generally circular path of motion to cause an intermediate portion of each of said elongated pedal members disposed between said first and second coupling portions to traverse a generally elliptical path of motion.

8. The multi-purpose exercise apparatus of claim 7 wherein each of said pair of elongated pedal members comprises a straight portion and an upwardly extending portion, each of said second foot receiving surfaces being provided on said upwardly extending portion.

9. The multi-purpose exercise apparatus of claim 7 wherein each of said pair of elongated pedal members comprises a straight portion, an upwardly extending mounting structure, a transverse shaft carried on said mounting structure at a position above said straight portion, and a rotatable pedal platform rotatably carried on said transverse shaft, each of said second foot receiving surfaces being provided on said rotatable pedal platform.

10. The multi-purpose exercise apparatus of claim 1 said feet engageable moving mechanism including a pair of elongated pedal members, each of said pair of pedal members comprising a straight portion and an upwardly extending portion, each of said second foot receiving surfaces being provided on said upwardly extending portion.

11. The multi-purpose exercise apparatus of claim 1, said feet engageable moving mechanism including a pair of elongated pedal members, each of said pair of pedal members comprising a straight portion, an upwardly extending mounting structure, a transverse shaft carried on said mounting structure at a position above said straight portion, and a rotatable pedal platform rotatably carried on said transverse shaft, each of said second foot receiving surfaces being provided on said rotatable pedal platform.

12. The multi-purpose exercise apparatus of claim 2, said feet engageable moving mechanism including a pair of elongated pedal members and a rotatable pedal platform associated with each of said pair of elongated pedal members and disposed proximate a rear end thereof, said rotatable pedal platform being constructed and arranged to be rotatable with respect to said associated elongated pedal member.

13. The multi-purpose exercise apparatus of claim 8 wherein said pedal guide mechanism comprises a transverse shaft carried by said frame structure and providing a roller element associated with each of said elongated pedal members and wherein said second coupling portion of each elongated pedal member comprises a roller guide structure constructed and arranged to receive said roller element and direct said roller element so that as said first coupling portion traverses the generally circular path of motion about said transverse axis, said elongated pedal member translates and pivots with respect to said transverse shaft.

14. The multi-purpose exercise apparatus of claim 7 wherein said pedal guide mechanism comprises a second generally horizontal transverse axis carried on said frame structure and said second coupling portion of each of said elongated pedal members is constructed and arranged to engage said second transverse axis and enable said elongated pedal member to translate and pivot about said second transverse axis.

15. The multi-purpose exercise apparatus of claim 14 wherein said transverse axis is disposed closer to a rear end of said frame structure than said transverse shaft.

16. The multi-purpose exercise apparatus of claim 14 wherein said transverse shaft is disposed closer to a rear end of said frame structure than said transverse axis.

17. The multi-purpose exercise apparatus of claim 7 wherein said pedal guide mechanism comprises a reciprocal movement guide element associated with each of said pair of elongated pedal members and constructed and arranged to direct said second coupling portion of each of said pedal members along a reciprocal path of motion as said first coupling portion traverses the generally circular path of motion.

18. The multi-purpose exercise apparatus of claim 17 wherein said reciprocal movement guide element comprises a guide link associated with each elongated pedal member, said guide link being pivotally attached to said frame at one portion thereof and pivotally attached to said second coupling portion at another portion thereof.

19. The multi-purpose exercise apparatus of claim 7 wherein said pedal guide mechanism comprises a second generally horizontal transverse axis carried on said frame structure and a second pedal coupling member associated with said second coupling portion of each of said elongated pedal members, said second coupling member and said second coupling portion being constructed and arranged to direct said second coupling portion of each pedal member in an arcuate path about said second transverse axis as said first coupling portion transverses the generally circular path of motion about said first mentioned transverse axis.

20. The multi-purpose exercise apparatus of claim 7 wherein said pedal guide mechanism comprises a second generally horizontal transverse axis carried on said frame structure and said second coupling portion of each of said pedal members is constructed and arranged to engage said second transverse axis and enable said pedal member to translate and pivot about said second transverse axis.

21. The multi-purpose exercise apparatus of claim 1, said seat being constructed and arranged to adjusted in vertical and horizontal, fore and aft directions.

* * * * *